US005797370A

United States Patent [19]

Kimura et al.

[11] Patent Number: 5,797,370

[45] Date of Patent: Aug. 25, 1998

[54] AIR-FUEL RATIO CONTROL SYSTEM FOR INTERNAL COMBUSTION ENGINE

[75] Inventors: Eisuke Kimura; Toru Yano; Kohei Hanada; Yusuke Tatara; Takashi Haga; Masanori Hayashi, all of Saitama, Japan

[73] Assignee: Honda Giken Kogyo Kabushiki Kaisha, Tokyo, Japan

[21] Appl. No.: 804,008

[22] Filed: Feb. 21, 1997

[30] Foreign Application Priority Data

Feb. 21, 1996 [JP] Japan ..... 8-033337

[51] Int. Cl.[6] ..... F02D 41/04; F02M 25/07

[52] U.S. Cl. ..... 123/478; 123/492; 123/493; 123/571

[58] Field of Search ..... 123/478, 480, 123/492, 493, 571, 585, 681, 682, 683, 684, 698, 699, 673

[56] References Cited

U.S. PATENT DOCUMENTS 5,325,828 7/1994 Yamaguchi et al. ..... 123/571 X
5,413,078 5/1995 Mitsunaga et al. ..... 123/492
5,606,960 3/1997 Takahashi et al. ..... 123/684
5,642,709 7/1997 Ozaki et al. ..... 123/478 X

FOREIGN PATENT DOCUMENTS 7-279710 10/1995 Japan .

*Primary Examiner*—Tony M. Argenbright
*Attorney, Agent, or Firm*—Lyon & Lyon LLP

[57] ABSTRACT

An air-fuel ratio control system for an internal combustion engine having a fuel injection valve for each cylinder and an electronic air control valve (EACV) for controlling intake air bypassing the engine throttle valve. When the target air-fuel ratio is switched over from a rich value to a lean value, the amounts of fuel injected into the cylinders, for example, #1, #2, #3 and #4 cylinders are controlled so that they are sequentially decreased at predetermined intervals, and the EACV is controlled to be opened stepwise. This causes a decrease in engine torque generated by the switching-over of the target air-fuel ratio to be offset by an increase in engine torque generated by an increase in amount of air drawn, thereby preventing the generation of a torque shock. At this time, the target opening degree of the EACV is corrected based on the magnitude of the interval and the magnitude of a loading of the internal combustion engine, thereby further effectively preventing the generation of the torque shock.

20 Claims, 15 Drawing Sheets

FIG.6

| PBa (High load) | | |
|---|---|---|
| KIAF1=1.00<br>KIAF2=1.00<br>KIAF3=1.00 | KIAF1=0.50<br>KIAF2=0.75<br>KIAF3=1.00 | KIAF1=0.25<br>KIAF2=0.50<br>KIAF3=0.75 |
| KIAF1=1.10<br>KIAF2=1.00<br>KIAF3=1.00 | KIAF1=1.00<br>KIAF2=1.00<br>KIAF3=1.00 | KIAF1=0.25<br>KIAF2=0.50<br>KIAF3=0.75 |
| KIAF1=1.20<br>KIAF2=1.10<br>KIAF3=1.00 | KIAF1=1.10<br>KIAF2=1.00<br>KIAF3=1.00 | KIAF1=0.30<br>KIAF2=0.50<br>KIAF3=0.75 |

(Low load)

(Small) → (Large)

Interval

High Ne
Low Ne
IAF1
IAF2
θTH
Throttle opening degree (θTH)
Basic drive amount (IAF)

IAF1
IAF2
IAF interpolation value
Ne
Engine revolution-number (Ne)

IAF interpolation value
IAF final interpolation value
A/F
Target air-fuel ratio (A/F)

AIR-FUEL RATIO CONTROL SYSTEM FOR INTERNAL COMBUSTION ENGINE

BACKGROUND OF THE INVENTION

1. Field of the Invention

The present invention relates to an air-fuel ratio control system for an internal combustion engine, including: fuel injection valves provided for cylinders, a target air-fuel ratio setting means for setting a target air-fuel ratio based on an operational state of the internal combustion engine, a fuel injection amount control means for changing the amount of fuel injected from the fuel injection valves for every cylinder based on the target air-fuel ratio, and a drawn-air amount control means for controlling the amount of air drawn into the internal combustion engine.

2. Description of the Related Art

Such an air-fuel ratio control system for an internal combustion engine has already been proposed in Japanese Patent Application Laid-open No. 7-279710 by the present assignee.

In the above proposed air-fuel ratio control system for an internal combustion engine, when the target air-fuel ratio for the internal combustion engine is switched over, for example, from a rich value to a lean value, the amounts of fuel injected from the fuel injection valves provided in the cylinders are sequentially decreased at predetermined intervals so as to exceed a mean air-fuel ratio at which the emission is deteriorated, and the amounts of air drawn into the internal combustion engine (the amount of secondary air bypassing a throttle valve) are sequentially increased at such predetermined intervals, thereby avoiding a torque shock produced when the amounts of fuel injected into all the cylinders are simultaneously decreased, and preventing the deterioration of the emission, while enhancing the drivability.

In the above proposed system, the decrease in engine torque due to a decrease in amount of fuel injected is compensated by an increase in amount of air drawn to avoid the generation of the torque shock. However, the generation of the torque shock cannot be necessarily sufficiently avoided due to a delay in operation response of an electronic air control valve (which will be simply referred to as EACV hereinafter) for controlling the amount of air drawn and/or a delay in response of the flow of the drawn air passing through the EACV.

The reason for the foregoing has been found by studies made by the present assignee. More specifically, as shown in FIG. 14A, when the target air-fuel ratio for the internal combustion engine is changed from a stoichiometric (rich) value to a lean value, even if the engine torque is intended to be maintained flat by sequentially decreasing the amounts of fuel injected into the four cylinders to switch over the target air-fuel ratios for the four cylinders in the internal combustion engine from the stoichiometric value to the lean value at predetermined intervals T, while at the same time, sequentially increasing the opening degree of the EACV at such predetermined intervals T, the generation of the torque shock cannot be avoided because of the presence of a delay in response to the increase in intake pipe internal absolute pressure (i.e., in actual amount of air drawn).

Such a torque shock is significant when the interval T is small. If the interval is set at a larger value as shown in FIG. 14B, the influence of the delay in response of the EACV and the influence of the delay in response of the flow of the drawn air are alleviated, resulting in the torque shock reduced. Namely, when the opening degree of the EACV is changed in response to the changing of the amount of fuel injected to avoid the generation of the torque shock, it is necessary to determine the opening degree of the EACV in consideration of the delay in response of the amount of air drawn.

It has been also found that the response of the amount of air drawn to the change of the opening degree of the EACV is varied depending upon the loaded state of the internal combustion engine. FIG. 15A shows the time required for the intake pipe internal absolute pressure to increase up to a predetermined value (corresponding to 1.6 times) from the time point of opening of the EACV with respect to the loaded state of the internal combustion engine. FIG. 15B shows the number of TDCs required to reach 90% of the final intake pressure PB. It can be seen from FIGS. 15A and 15B, the higher the load, the smaller the delay in response is, and hence, the intake pipe internal absolute pressure is increased quickly. Namely, when the delay in response of the amount of air drawn is taken into consideration, the loaded state of the internal combustion engine is an important parameter.

SUMMARY OF THE INVENTION

Accordingly, it is an object of the present invention to effectively avoid the generation of a torque shock during switching-over of the target air-fuel ratio, while preventing the deterioration of the emission, by taking the delay in response of the amount of air drawn to the operation of the drawn-air amount control means into consideration.

To achieve the above object, according to the present invention, there is provided an air-fuel ratio control system for an internal combustion engine, including: fuel injection valves provided for cylinders, a target air-fuel ratio setting means for setting a target air-fuel ratio based on an operational state of the internal combustion engine, a fuel injection amount control means for changing the amount of fuel injected from the fuel injection valves for every cylinder based on the target air-fuel ratio, and a drawn-air amount control means for controlling the amount of air drawn into the internal combustion engine, wherein the drawn-air amount control means corrects a basic drawn-air amount in accordance with the change in the amount of fuel injected into each of the cylinders.

With such arrangement, a variation in engine torque generated in accordance with the changed state of the amount of fuel injected can be offset by a variation in engine torque generated by the correction of the basic amount of air drawn, thereby effectively preventing the generation of a torque shock.

If the fuel injection amount control means sequentially changes the amounts of fuel injected with a predetermined time lag for every fuel injection valve when the target air-fuel ratio setting means has switched the target air-fuel ratio, a torque shock generated depending upon the magnitude of the time lag can be effectively offset by the correction of the basic amount of air drawn.

If the drawn-air amount control means corrects the basic amount of air drawn in accordance with the load of the internal combustion engine, a variation in engine torque generated depending upon a variation in the loading can be offset by a variation in engine torque generated by the correction of the basic amount of air drawn to effectively prevent the generation of a torque shock.

The above and other objects, features and advantages of the invention will become apparent from the following description of preferred embodiments taken in conjunction with the accompanying drawings.

BRIEF DESCRIPTION OF THE DRAWINGS

FIG. 6 shows a table for searching a correcting factor;

DETAILED DESCRIPTION OF THE PREFERRED EMBODIMENTS

A first embodiment of the present invention will now be described with reference to FIGS. 1 to 9.

Figure 1:
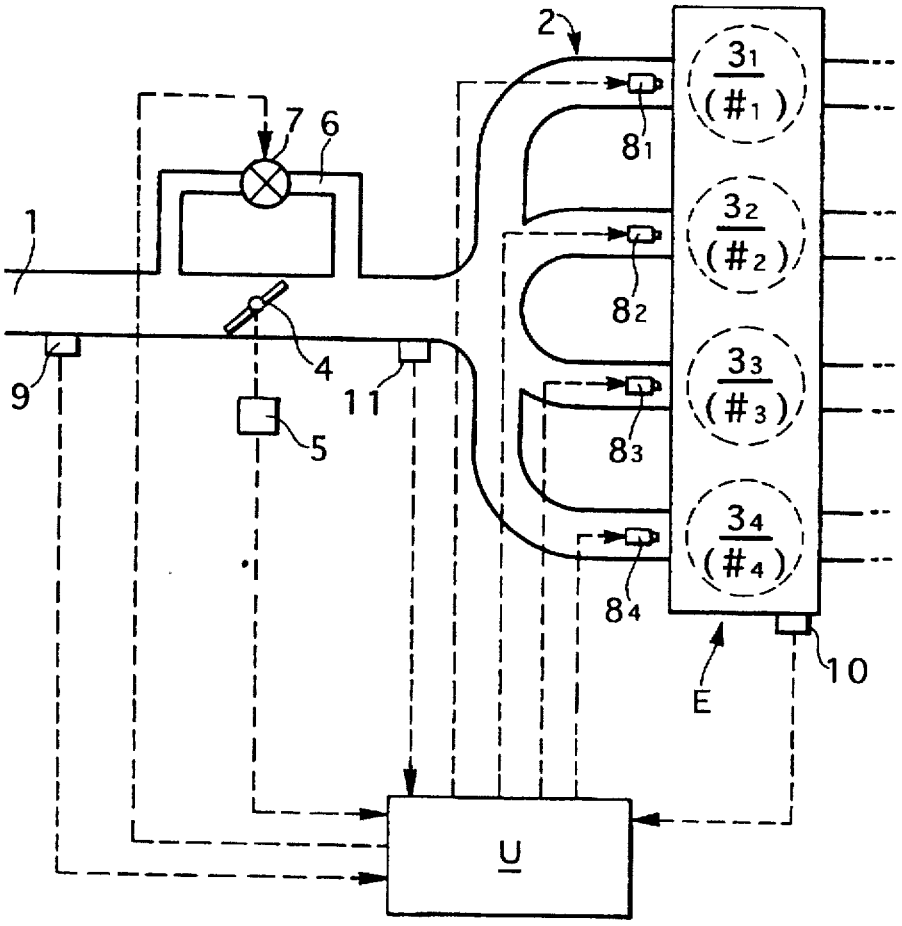
FIG. 1 is an diagrammatic illustration of the entire arrangement of an air-fuel ratio control system in an internal combustion engine according to a first embodiment of the present invention.

Referring to FIG. 1, an intake passage 1 in a 4-cylinder internal combustion engine E (which will be merely preferred to as an engine E hereinafter) is connected to four #1, #2, #3 and #4 cylinders $3_1$, $3_2$, $3_3$ and $3_4$ through an intake manifold 2. A throttle valve 4 is mounted in the intake passage 1 and connected to an accelerator pedal (not shown) for opening and closing. A throttle opening degree sensor 5 is connected to the throttle valve 4 for detecting a throttle opening degree θTH. A signal from the throttle opening degree sensor 4 is inputted to an electronic control unit U. An EACV 7 is provided in a bypass passage 6 which is connected to the intake passage 1 to bypass the throttle valve 4. The EACV 7 is connected to and controlled by the electronic control unit U.

Four fuel injection valves $8_1$, $8_2$, $8_3$ and $8_4$ are provided in the manifold 2 in correspondence to the four cylinders $3_1$, $3_2$, $3_3$ and $3_4$. The fuel injection valves $8_1$, $8_2$, $8_3$ and $8_4$ are connected to and controlled by the electronic control unit U.

An intake air amount sensor 9 comprising an air flow meter for detecting an amount of intake air is provided in the intake passage 1 upstream of the throttle valve 4, and a signal from the intake air amount sensor 9 is inputted to the electronic control unit U. An engine revolution-number sensor 10 is provided within the engine E for detecting a number Ne of revolutions of the engine based on the rotations of a crankshaft which is not shown, and a signal from the engine revolution-number sensor 10 is inputted to the electronic control unit U. Further, an intake pipe internal absolute pressure sensor 11 is provided in the intake passage 1 downstream of the throttle valve 4 for detecting an internal absolute pressure PBa in an intake pipe, and a signal from the intake pipe internal absolute pressure sensor 11 is inputted to the electronic control unit U. The engine revolution-number sensor 10 outputs a crank angle signal and a cylinder discriminating signal simultaneously in addition to the engine revolution-number Ne.

Figure 2:
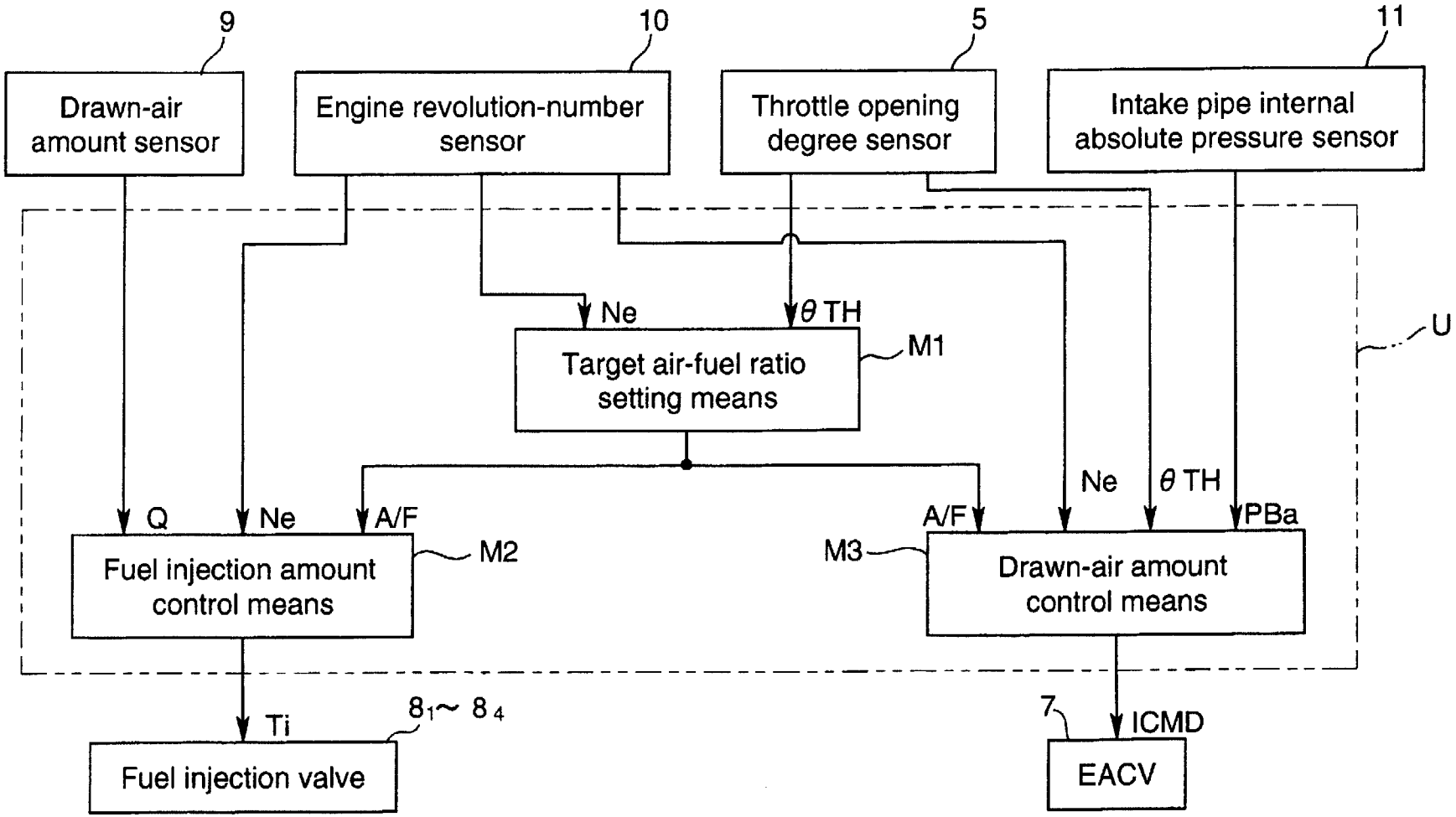
FIG. 2 is a block diagram illustrating a circuit arrangement of an electronic control unit.

As shown in FIG. 2, the electronic control unit U includes a target air-fuel ratio setting means M1 for switching over a target air-fuel ratio based on an operational state of the engine E, a fuel injection amount control means M2 for controlling the amount of fuel injected from the fuel injection valves $8_1$, $8_2$, $8_3$ and $8_4$ based on the target air-fuel ratio, and a drawn-air amount control means M3 for controlling the amount of air drawn by controlling the opening degree of the EACV 7 based on the target air-fuel ratio.

The throttle opening degree θTH detected by the throttle opening degree sensor 5 and the engine revolution-number Ne detected by the engine revolution-number sensor 10 are inputted to the target air-fuel ratio setting means M1, and a target air-fuel ratio A/F is searched in a map based on the throttle opening degree θTH and the engine revolution-number Ne. In a usual operational state of the engine, the target air-fuel ratio is set at A/F=14.7 which is a stoichiometric (rich), i.e., ideal theoretical air-fuel ratio. On the other hand, in a particular operational state such as during deceleration of the engine E, the target air-fuel ratio is remarkably leaned to provide a reduction in specific fuel consumption and for example, the target air-fuel ratio is set at A/F=23.

When the target air-fuel ratio is the stoichiometric air-fuel ratio, the fuel injection amount control means M2 sets a fuel injection amount Ti corresponding to an amount of air drawn Q detected by the drawn-air amount sensor 9 and an engine revolution-number Ne detected by the engine revolution-number sensor 10 so as to provide the stoichiometric air-fuel ratio. On the other hand, when the target air-fuel ratio is leaned lower than the stoichiometric air-fuel ratio, the fuel injection amount Ti is set so as to provide the leaned target air-fuel ratio. At the switch-over of the target air-fuel ratio, the timing of changing the fuel injection amount Ti is controlled for every cylinder $3_1$, $3_2$, $3_3$ and $3_4$ with a predetermined time lag which will be described hereinafter. The function of the fuel injection amount control means M2 will be described hereinafter with reference to a flowchart.

The drawn-air amount control means M3 controls the amount of air drawn by controlling the opening degree ICMD of the EACV 7 in accordance with an increase or a decrease in fuel injection amount Ti at the switch-over of the target air-fuel ratio. At this time, the opening degree ICMD of the EACV 7 is determined based on the throttle opening degree θTH, the engine revolution number Ne and the intake pipe internal absolute pressure PBa. The function of the drawn-air amount control means M3 will be described hereinafter with reference to a flowchart.

The operation of the embodiment of the present invention will be described below.

In this embodiment, five statuses ST-AFCHG "0", "1", "2", "3" and "4", i.e., ST-AFCHG "0" (all the cylinders are stoichiometric), ST-AFCHG "1" (one cylinder is lean), ST-AFCHG "2" (two cylinders are lean), ST-AFCHG "3" (three cylinders are lean), ST-AFCHG "4" (all the cylinders are lean) are established. The amount of fuel injected from the fuel injection valves $8_1$, $8_2$, $8_3$ and $8_4$ and the opening degree of the EACV 7 are controlled based on the statuses ST-AFCHG "0", "1", "2", "3" and "4".

Figure 3:
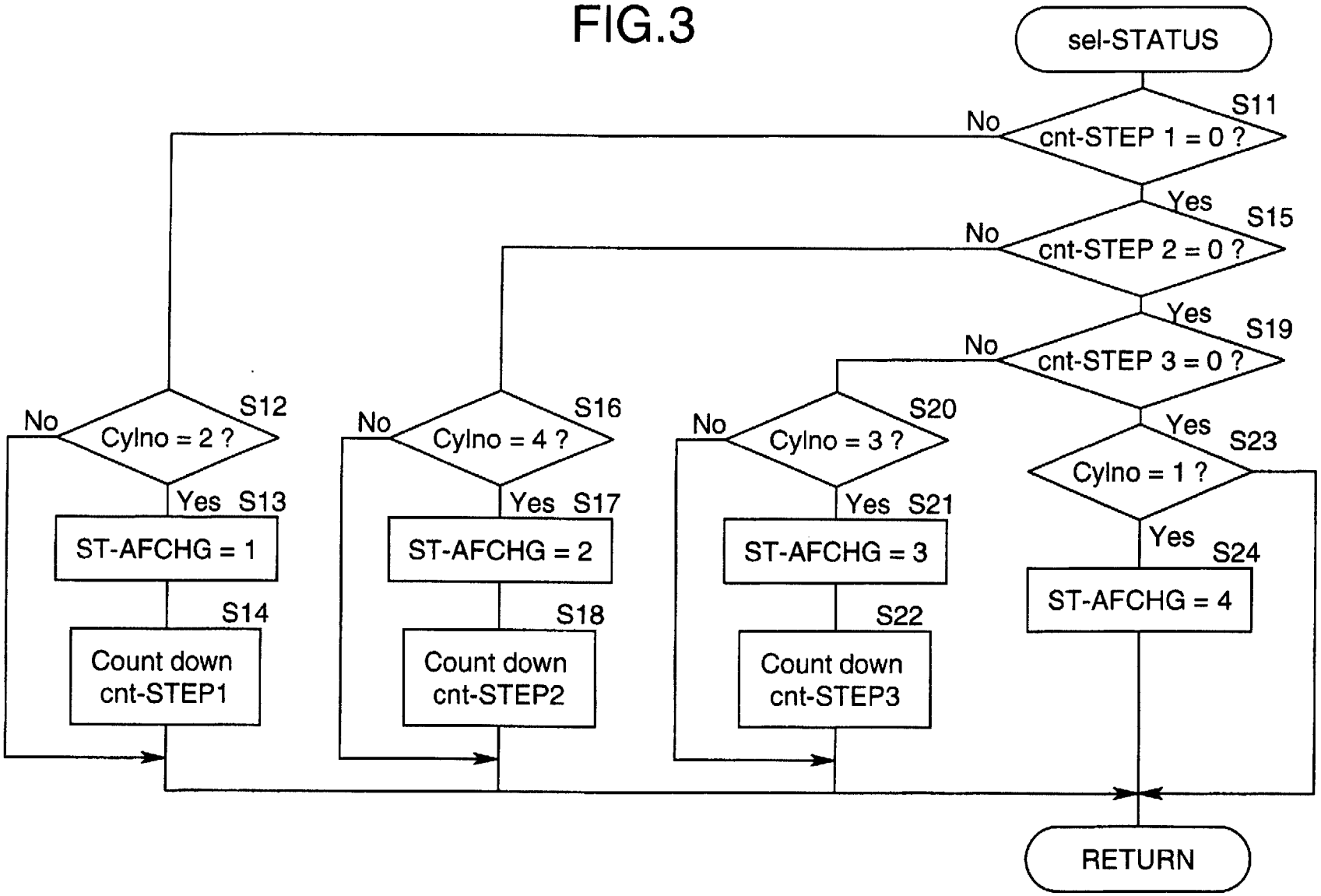
FIG. 3 is a flowchart for a status control routine.

A flowchart shown in FIG. 3 illustrates a status control routine for determining the status ST-AFCHG, when the air-fuel ratio is switched over from a stoichiometric value to a lean value (stoichiometric→lean). This routine is carried out for every top dead center position TDC of a piston in a cylinder. In this embodiment, the switch-over of the air-fuel ratio is conducted in an order of #2 cylinder $3_2$→#4 cylinder→#3 cylinder $3_3$→#1 cylinder $3_1$.

Before a condition for switching over the air-fuel ratio from the stoichiometric value to the lean value is established, the status ST-AFCHG is set at "0"; a first interval counter cnt-STEP1 is set at "6"; a second interval counter cnt-STEP2 is set at "3"; and a third interval counter cnt-STEP3 is set at "3".

When the air-fuel ratio switching condition has been established by the change of the operational state of the engine E, since the first interval counter cnt-STEP 1 is equal to "6", which is an initial value, the determination at step S11 of whether cnt-Step 1=0 is negative (N) and hence, the processing is advanced to step S12. It is determined at step S12 whether the cylinder number Cylno (i.e., the number of the cylinder $3_1$, $3_2$, $3_3$, $3_4$ which is in a compression stroke) is "2". When the cylinder number Cylno is "2", the status ST-AFCHG is switched over from "0" to "1" at step S13 and then, the first interval counter cnt-STEP1 is counted down from "6", which is an initial value, to "5", at step S14.

The above-described processings are conducted for every TDC (every loop). Every time the cylinder number Cylno becomes "2" (one time in one cycle, namely, in 4 TDCs), the first interval counter cnt-STEP1 is counted down one by one. As a result, when the first interval counter cnt-STEP1 becomes "0" at step S11 after the lapse of 6 cycles, namely, 24 TDCs, the processing is passed to step S15. At the beginning, since the second interval counter cnt-STEP2 is "3", which is an initial value, the determination at step S15 is No and hence, the processing is passed to step S16 at which it is determined whether the cylinder number Cylno is "4". When the cylinder number Cylno becomes "4" after 3 TDCs, the status ST-AFCHG is switched over from "1" to "2" at step S17 and then, the second interval counter cnt-STEP2 is counted down from "3", which is the initial value, to "2" at step S18.

In this manner, the second interval counter cnt-STEP2 is counted down one by one in every one cycle, namely, in every 4 TDCs. When the second interval counter cnt-STEP2 becomes "0" at step S15 after the lapse of 3 cycles, namely, 12 TDCs, the processing is advanced to step S19. At the beginning, since the third interval counter cnt-STEP3 is "3", which is the initial value, the determination at step S19 is No and hence, the processing is advanced to step S20 at which it is determined whether the cylinder number Cylno is "3". When the cylinder number Cylno becomes "3" after 3 TDCs, the status ST-AFCHG is switched over from "2" to "3" at step S21, and then, the third interval counter cnt-STEP3 is counted down from "3", which is the initial value, to "2" at step S22.

In this manner, the third interval counter cnt-STEP3 is counted down one by one in every one cycle, namely, every 4 TDCS. When the third interval counter cnt-STEP3 becomes "0" at step S19 after lapse of 3 cycles, namely, 12 TDCS, the processing is passed to step S23 at which it is determined whether the cylinder number Cylno is "1". When the cylinder number Cylno becomes "1" after 3 TDCs, the status ST-AFCHG is switched over from "3" to "4" at step S24.

As a result, the status ST-AFCHG is maintained in a state of "1" between 24+3=27 TDCs and in a state of "2" and "3" between 12+3=15 TDCs each.

Figure 5:
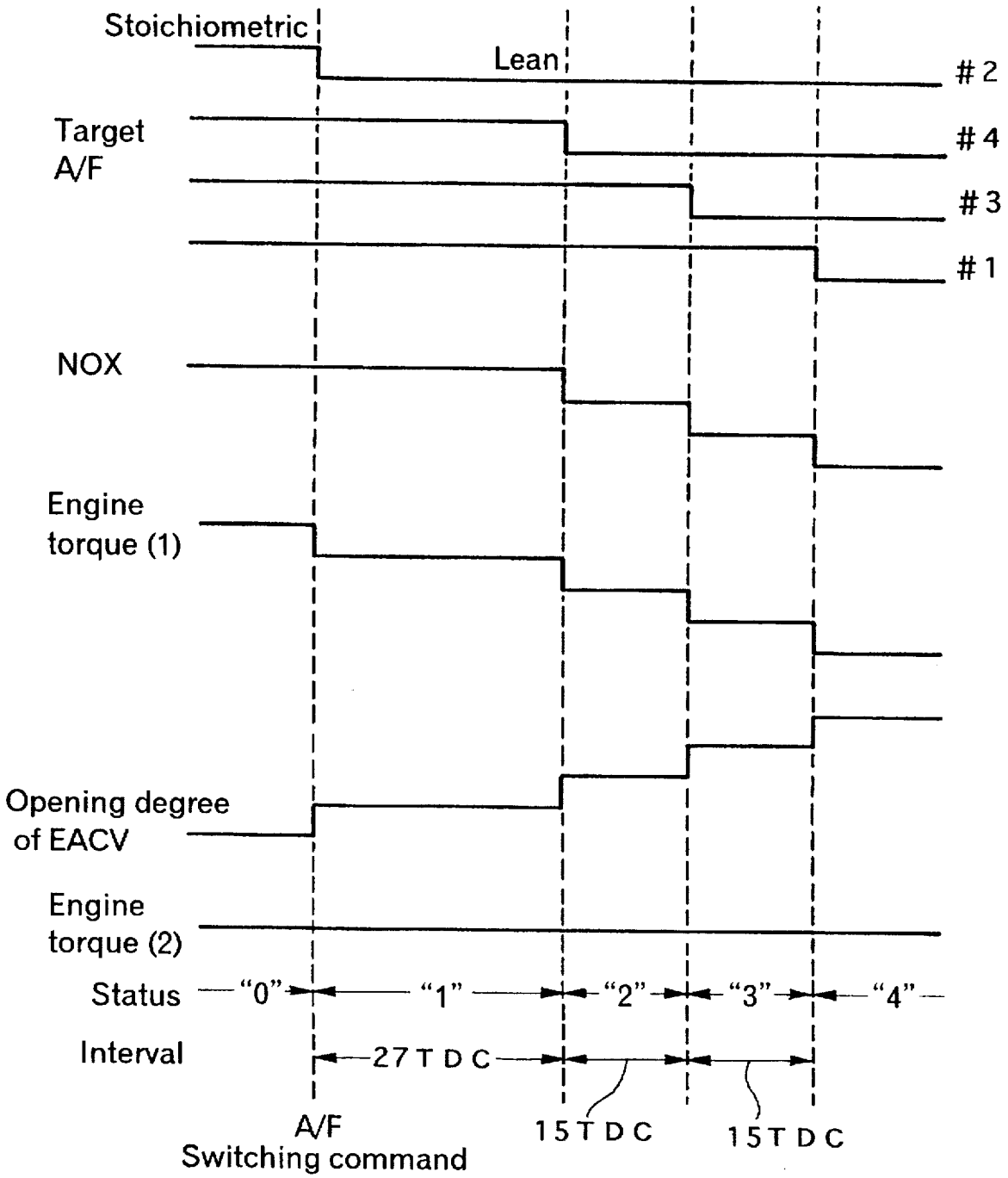
FIG. 5 is a time chart for explaining the operation.

As is apparent from a timing chart in FIG. 5, when the status ST-AFCHG is "0", the air-fuel ratios for all the cylinders $3_1$, $3_2$, $3_3$ and $3_4$ are set at the stoichiometric value. When the status ST-AFCHG is "1", the air-fuel ratio for the #2 cylinder $3_2$ is changed to the lean value. When the status ST-AFCHG is "2", the air-fuel ratios of the #2 and #4 cylinders $3_2$ and $3_4$ are set at the lean value. When the status ST-AFCHG is "3", the air-fuel ratios for the #2, #4 and #3 cylinders $3_2$, $3_4$ and $3_3$ are set at the lean value. When the status ST-AFCHG is "4", the air-fuel ratios for all the cylinders $3_1$, $3_2$, $3_3$ and $3_4$ are set at the lean value.

In other words, as the stoichiometric→lean switching condition is established and the status ST-AFCHG is changed in steps from "0" to "4", the air-fuel ratios for the four cylinders $3_1$, $3_2$, $3_3$ and $3_4$ are sequentially switched over from the stoichiometric value to the lean value. At this time, in the embodiment, the interval of the status ST-AFCHG "1" is set at 27 TDCs; the interval of the status ST-AFCHG "2" is set at 15 TDCs; and the interval of the status ST-AFCHG "3" is set at 15 TDCs, by setting the initial values of the first, second and third interval counters cnt-STEP1, CNT-STEP2 and cnt-STEP3 at "6", "3" and "3", respectively.

When the target air-fuel ratio is switched over from the lean value to the stoichiometric value, the status ST-AFCHG is switched over from "4" corresponding to the lean value to "0" corresponding to the stoichiometric value in a predetermined order of "5" (the #2 cylinder $3_2$ is stoichiometric) →"6" (the #2 and #4 cylinders $3_2$ and $3_4$ are stoichiometric) →"7" (the #2, #4 and #3 cylinders $3_2$, $3_4$ and $3_3$ are stoichiometric).

When the status ST-AFCHG is determined based on the flowchart in FIG. 3, the amount Ti of fuel injected from the fuel injection valves $8_1$, $8_2$, $8_3$ and $8_4$ is controlled on accordance with such status ST-AFCHG. As shown in the timing chart in FIG. 5, when the air-fuel ratio switching condition is established and the status ST-AFCHG becomes "1", the amount of fuel injected into the #2 cylinder $3_2$ is decreased, and the target air-fuel ratio A/F therefor is switched from the stoichiometric value to the lean value. After a lapse of the interval of 27 TDCs therefrom, the amount of fuel injected into the #4 cylinder $3_4$ is decreased, and the target air-fuel ratio A/F therefor is switched from the stoichiometric value to the lean value. After a lapse of the interval of 15 TDCs therefrom, the amount of fuel injected into the #3 cylinder $3_3$ is decreased, and the target air-fuel ratio A/F therefor is switched from the stoichiometric value to the lean value. After a lapse of the interval of 15 TDCs therefrom, the amount of fuel injected into the #1 cylinder $3_3$ is decreased, and the target air-fuel ratio A/F therefor is switched from the stoichiometric value to the lean value.

In this manner, the deterioration of the emission can be a prevented by changing the target air-fuel ratio for each of the cylinders $3_1$, $3_2$, $3_3$ and $3_4$ from the stoichiometric value to the lean value beyond a mean air-fuel ratio (A/F=15 to 23) which extremely deteriorates the emission. Moreover, in this case, the amounts of fuel injected to the four cylinders $3_1$, $3_2$, $3_3$ and $3_4$ are sequentially changed at predetermined intervals and therefore, the engine torque can be prevented from being suddenly changed, thereby avoiding the degradation of the drivability.

However, by only the above-described control of the amounts of fuel injected, it is impossible to completely avoid that the torque is stepwise decreased, because the target air-fuel ratios for the cylinders $3_1$, $3_2$, $3_3$ and $3_4$ are sequentially leaned (see the engine torque (1) in FIG. 5). Thereupon, by using an increasing control of the amount of air drawn through the EACV 7 in combination with a decreasing control of the amount of fuel injected, the decreasing of the engine torque can be avoided to further effectively prevent the generation of a torque shock.

More specifically, when the target air-fuel ratio is changed from the stoichiometric value to the lean value, the opening degree of the EACV 7 is stepwise increased in parallel to the decreasing control of the amount of fuel injected which is carried out for every cylinder $3_1$, $3_2$, $3_3$, $3_4$, thereby increasing the amount of air drawn to prevent the decreasing of the engine torque. As a result, even if the amounts of fuel injected are sequentially decreased for every cylinder $3_1$, $3_2$, $3_3$ and $3_4$, the engine torque is maintained flat as a whole, and the prevention of the deterioration of the emission and the prevention of the generation of the torque shock can be effectively reconciled (see the engine torque (2) in FIG. 5).

Figure 4:
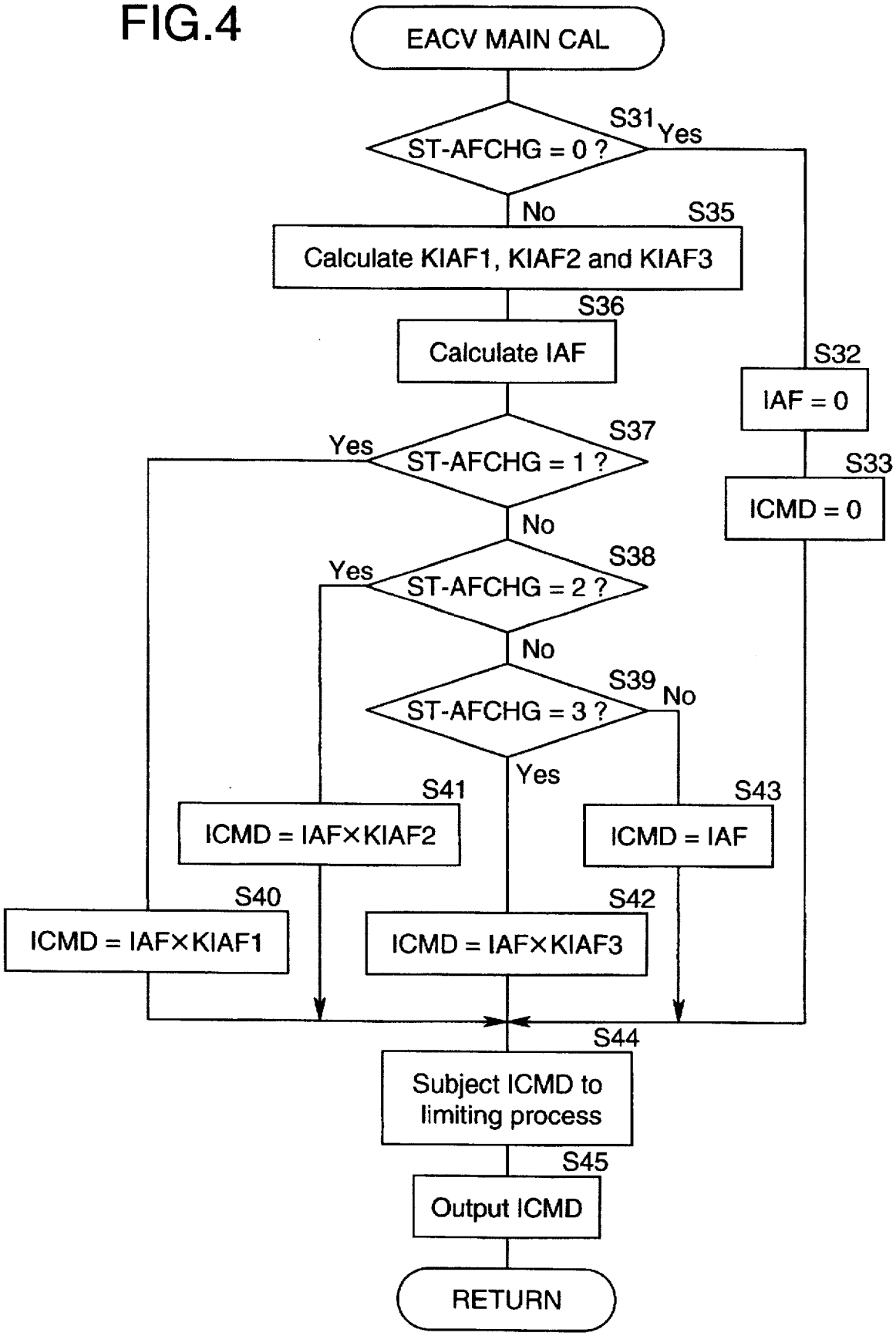
FIG. 4 is a flowchart for an EACV opening degree control routine.

The control of the opening degree of the EACV 7 will be described below with reference to a flowchart illustrating a routine for controlling the opening degree of the EACV in FIG. 4.

First, if the status ST-AFCHG is "0" (before the start of the air-fuel ratio switch-over control) at step S31, the basic drive amount IAF of the EACV 7 corresponding to the target air-fuel ratio is set at 0 at step S32, whereby the drive amount ICMD of the EACV 7 is set at ICMD=0 at step S33. The air-fuel ratio switch-over control is started by the change of the operational state of the engine E. When the status ST-AFCHG is not "0" at step S31, the processing is passed to step S35.

At step S35, correcting factors KIAF1, 2 and 3 for correcting the basic drive amount of the EACV 7 are searched based on the interval of such status ST-AFCHG and the intake pipe internal absolute pressure PBa (i.e., the load of the engine E). FIG. 6 shows a table for searching the correcting factors KIAF1, 2 and 3. As is apparent from the table, the correcting factors KIAF1, 2 and 3 are set so that they are decreased, as the intake pipe internal absolute pressure PBa is increased.

Figures 7A, 7B, 7C:
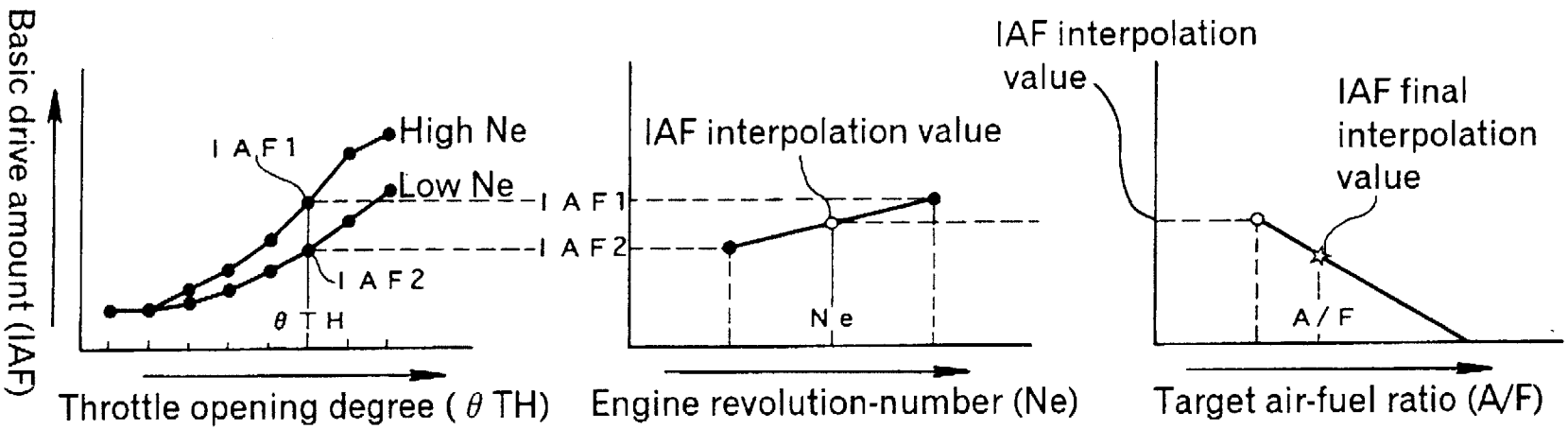
FIGS. 7A to 7C show maps for determining a basic drive amount of EACV.

Then, at step S36, a basic drive amount IAF of the EACV 7 is calculated based on the throttle opening degree θTH, the engine revolution-number Ne and the target air-fuel ratio A/F. First, a basic drive amount IAF1 at a higher Ne and a basic drive amount IAF2 at a lower Ne are searched from the throttle opening degree θTH based on a map shown in FIG. 7A. Then, the two basic drive amounts IAF1 and IAF2 searched based on the map shown in FIG. 7B are interpolated by the engine revolution-number Ne, and the interpolation value is interpolated by the target air-fuel ratio A/F based on a map shown in FIG. 7C to calculate a final basic drive amount IAF of the EACV 7.

In the calculation of such basic drive amount IAF of the EACV 7, the throttle opening degree θTH is used as a parameter which reflects an output torque from the engine demanded by a driver. However, if the intake pipe internal absolute pressure PBa is used in place of the throttle opening degree θTH, such intake pipe internal absolute pressure PBa is varied by the control for opening and closing the EACV 7 and hence, the torque demanded by the driver is not correctly reflected. For this reason, disadvantages of a torque shock being generated and a reduced responsiveness occur. However, the occurrence of such disadvantages can be avoided by calculating the basic drive amount IAF using the throttle opening degree θTH as in this embodiment. Even if the accelerator opening degree is employed in place of the throttle opening degree θTH, similar operation and effect can be obtained.

Now, when the status ST-AFCHG is "1" at subsequent step S37, the drive amount ICMD of the EACV 7 is corrected at step S40 according to an equation of (ICMD=IAF×KIAF1), using the correcting factor KIAF1 searched at step S35. When the status ST-AFCHG is "2" at steps S37 and S38, the drive amount ICMD of the EACV 7 is corrected at step S41 according to an equation of (ICMD=IAF×KIAF2), using the correcting factor KIAF2 searched at step S35. When the status ST-AFCHG is "3" at steps S37 to S39, the drive amount ICMD of the EACV 7 is corrected at step S42 according to an equation of (ICMD=IAF×KIAF3), using the correcting factor KIAF3 searched at step S35. When the status ST-AFCHG is "4" at steps S37 to S39, the drive amount ICMD of the EACV 7 is corrected to ICMD=IAF at step S43.

Then, the drive amounts ICMD of the EACV 7 determined at steps S33, S40, S41, S42 and S43 are subjected to a predetermined limiting process at step S44 and then, the drive amounts ICMD are outputted at step S45 to control the opening degree of the EACV 7. Thus, as can be seen from FIG. 5, the opening degree of the EACV 7 is gradually varied as the status ST-AFCHG is varied from "1" to "4". Therefore, the engine torque is increased so as to compensate for the decrement of the engine torque due to the switch-over of the target air-fuel ratio A/F for each of the cylinders $3_1$, $3_2$, $3_3$ and $3_4$ from the stoichiometric value to the lean value, and the final engine torque is flat with less torque shock (see the engine torque (2) in FIG. 5).

In this case, in correcting the basic drive amount IAF using the correcting factors KIAF1, KIAF2 and KIAF3 in the statuses ST-AFCHG "1", "2" and "3", respectively, such correcting factors KIAF1, KIAF2 and KIAF3 are determined based on the length of the interval and the load of the engine E (the intake pipe internal absolute pressure PBa) and hence, the generation of the torque shock can be more effectively avoided.

Figure 14A:
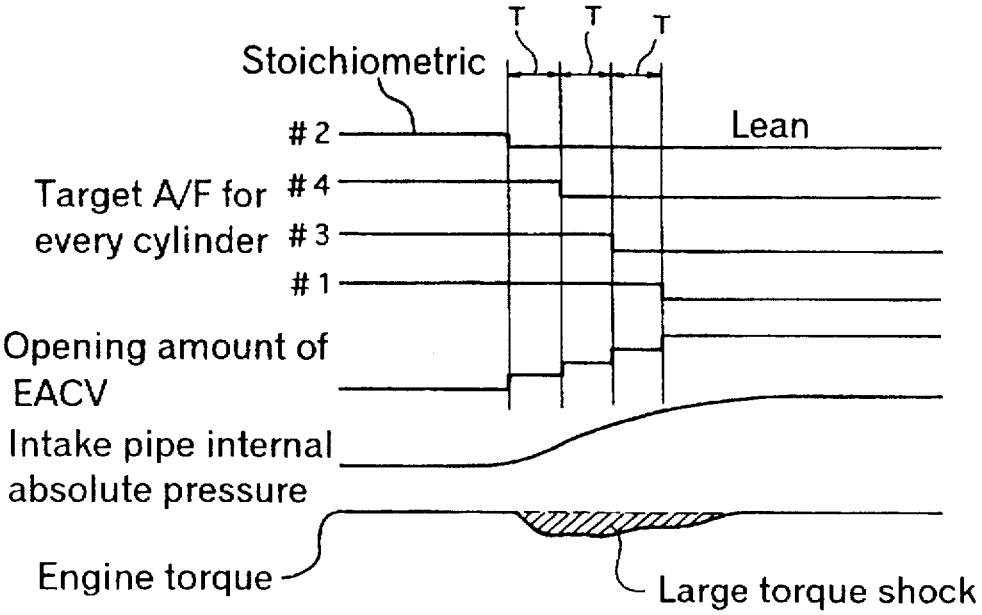
FIGS. 14A and 14B time chart for explaining the reason why a torque shock is generated.
Figure 14B:
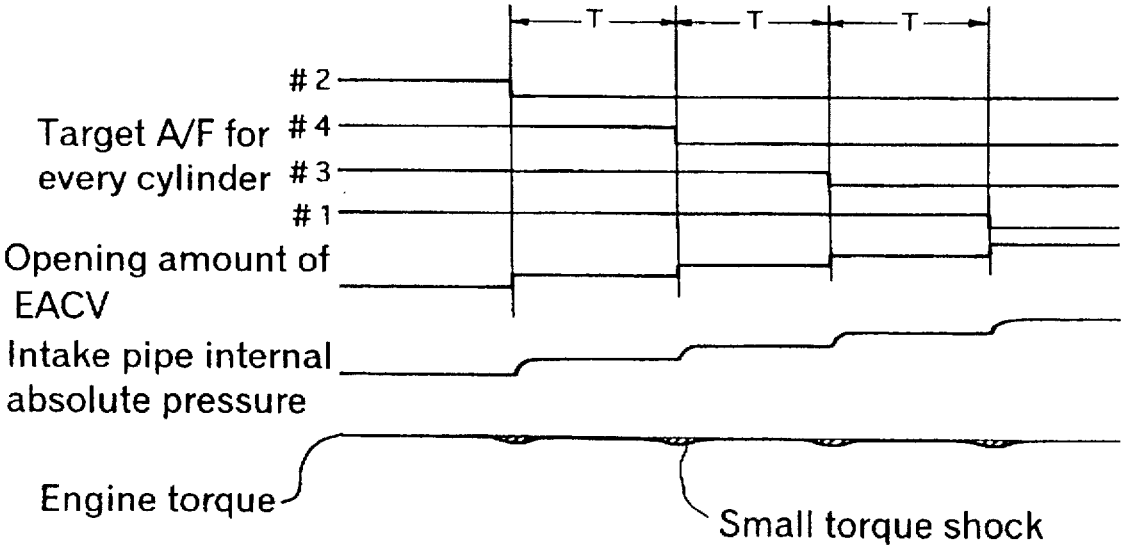
Figure 15A:
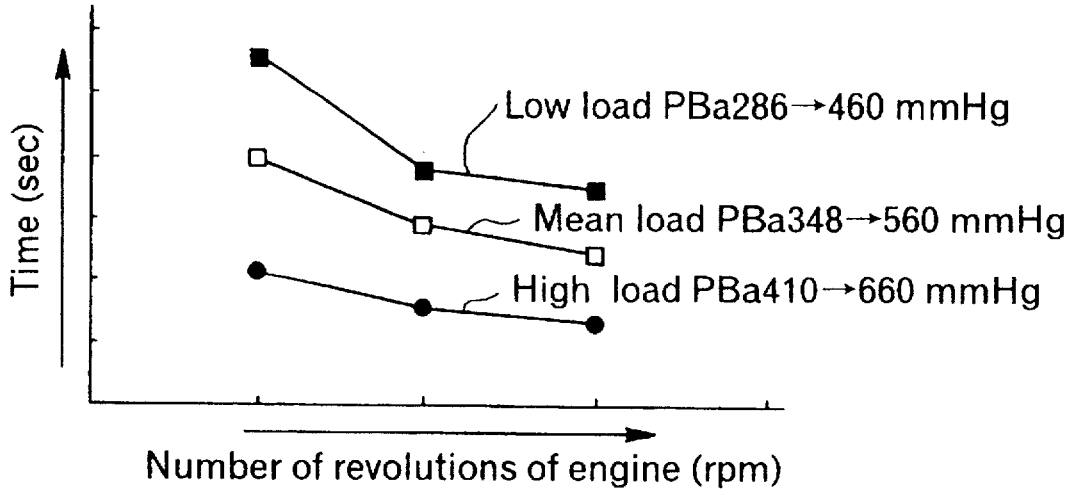
FIGS. 15A and 15B are graphs for explaining the reason why the torque shock is generated.
Figure 15B:
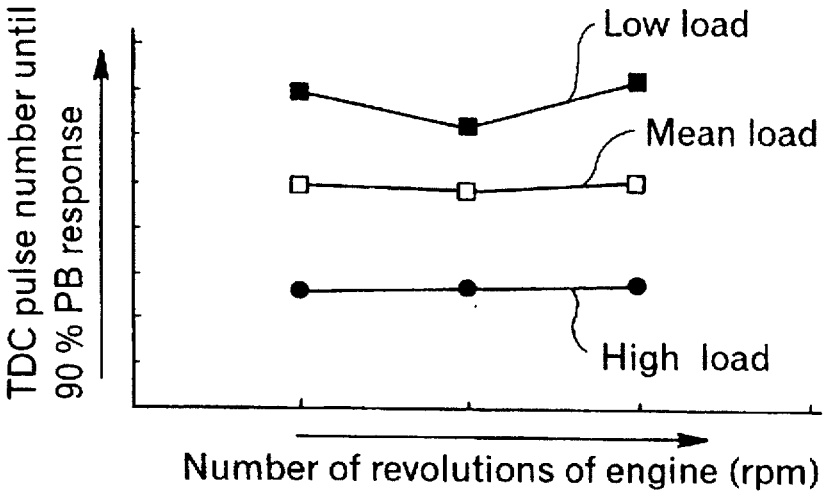

More specifically, as described with reference to FIG. 14, the more the interval is decreased, the more the torque shock is liable to be generated due to the delay in response of the amount of air drawn. However, as can be seen from the table in FIG. 6, as the interval is smaller, the correcting factors KIAF1, KIAF2 and KIAF3 are set at larger values to increase the drive amount ICMD of the EACV 7, thereby effectively avoiding the generation of the torque shock due to the delay in response of the amount of air drawn. In addition, as described with reference to FIG. 15, the more the load of engine E is decreased, the more the torque shock is liable to be generated due to the delay in response of the amount of air drawn. However, as the load (the intake pipe internal absolute pressure PBa) is smaller, the correcting factors KIAF1, KIAF2 and KIAF3 are set at larger values to increase the drive amount ICMD of the EACV 7, thereby effectively avoiding the generation of the torque shock due to the delay in response of the amount of air drawn.

The switching-over of the air-fuel ratio from the stoichiometric value to the lean value has been described above.

When the air-fuel ratio is to be switched over from the lean value to the stoichiometric value, the correcting factor KIAF may be determined and then, the drive amount of the EACV 7 may be determined in the same manner as in the switching-over of the air-fuel ratio from the stoichiometric value to the lean value. However, when an auxiliary air device such as the EACV 7 with a limited flow rate is employed, even if the status ST-AFCHG is switched over sequentially from "4" to "0", the correcting factor KIAF may be maintained at 1.00, and the basic drive amount IAF may be used intact as the drive amount ICMD of the EACV 7. This is because the case where the air-fuel ratio is switched over from the lean value to the stoichiometric value is when the driver depresses down the accelerator pedal with an accelerating intention, wherein the generation of somewhat of a torque shock offers no particular problem.

In the engine E in this embodiment in which the air-fuel ratio is switched over, the time of completion of the fuel injection for the lean-operated cylinder is changed relative to that for the stoichiometric-operated cylinder from the viewpoint of a combustion stability. Not only when the air-fuel ratio is switched over, but also in order to reconcile the combustion stability and the emission especially in a lean operation, the time of completion of the fuel injection is changed. However, if the time of completion of the fuel injection is changed in this manner, there is a possibility that an equilibrium adhesion rate in carrying out the correction of the adhesion of fuel on a wall surface may be largely changed and hence, the fuel within the cylinder is insufficient, thereby bringing about a variation in combustion, a misfiring, a deterioration in emission and the like.

Figure 8A:
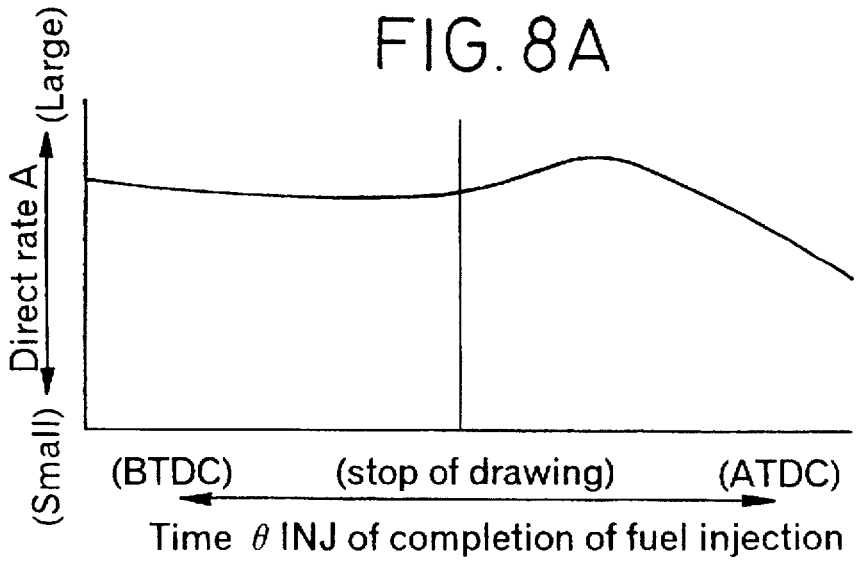
FIGS. 8A to 8C are graphs illustrating the variation in equilibrium adhesion rate with respect to the variation in time of completion of the fuel injection.
Figure 8B:
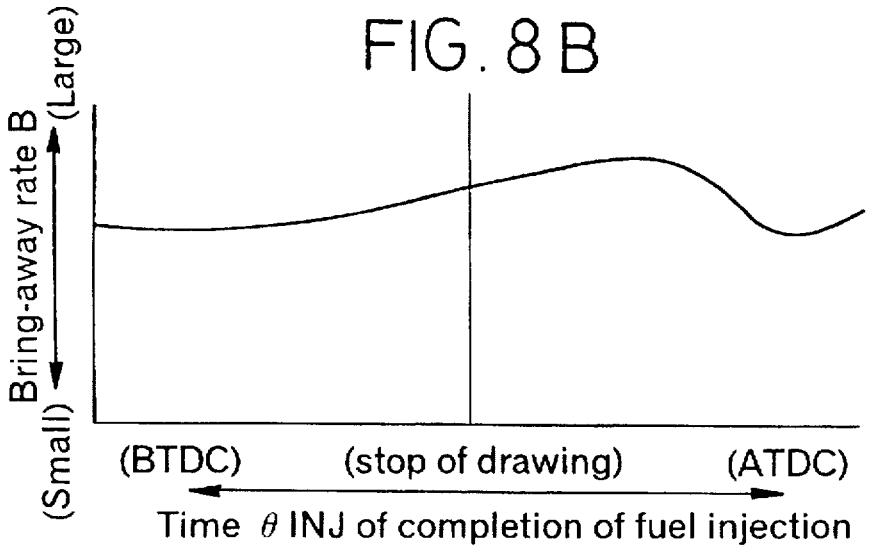
Figure 8C:
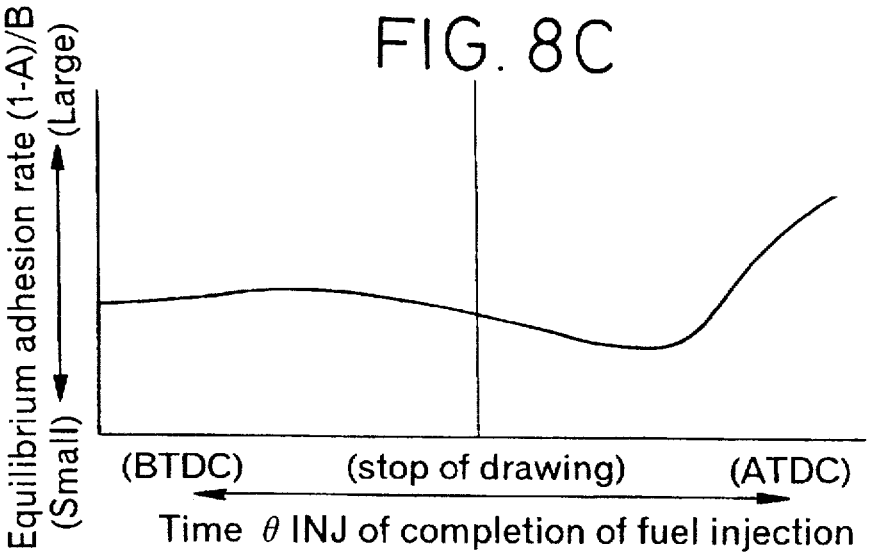
Figure 9A:
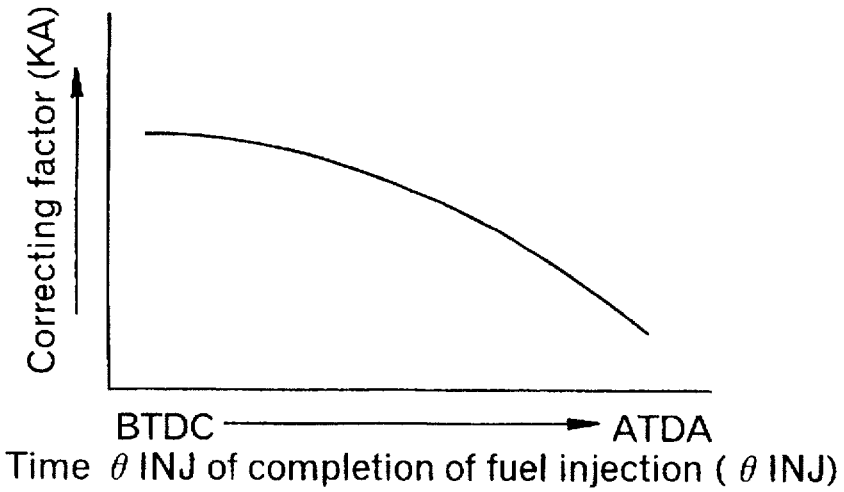
FIGS. 9A and 9B show maps for searching a correcting factor.
Figure 9B:
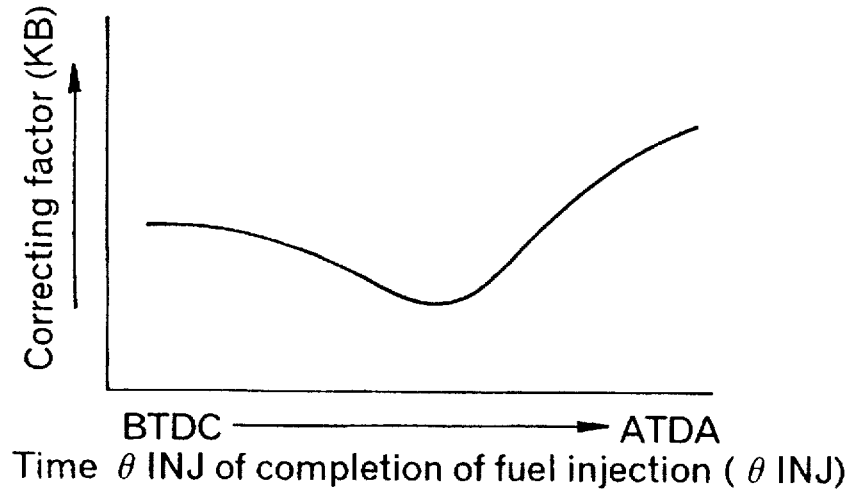

This will be described in detail with reference to FIGS. 8A, 8B and 8C. FIG. 8A shows the variation in a direct rate A (a proportion of that portion of the fuel injected from the fuel injection valve which is drawn directly into the cylinder when the time θINJ of completion of the fuel injection has been changed in the lean operation. FIG. 8B shows the variation in bring-away rate B (a proportion of that portion of the fuel adhered on the wall surface which is drawn into the cylinder) when the time θINJ of completion of the fuel injection has been changed in the lean operation. FIG. 8C shows the equilibrium adhesion rate=(1-A)/B determined from the direct rate A and the bring-away rate B. As the value of the equilibrium adhesion rate is smaller, the proportion of adhesion of the fuel on the wall surface is smaller, leading to a higher responsiveness of an intake system. However, as can be seen from FIG. 8C, if the time θINJ of completion of the fuel injection is retarded behind the intake top by a predetermined value or more, the equilibrium adhesion rate is sharply increased.

Therefore, in this embodiment, the amount of fuel injected is corrected by correcting the direct rate A and the bring-away rate B in accordance with the time θINJ of completion of the fuel injection, thereby eliminating the above-described disadvantage. The specific details thereof will be described below. First, the direct rate A and the bring-away rate B are map-searched based on the temperature TW of cooling water and the intake pipe internal absolute pressure PBa, and such map values are interpolated by the engine revolution-number Ne and the exhaust gas return EGR amount. Then, a correcting factor KA for the direct rate A is searched from the time θINJ of completion of the fuel injection based on a map in FIG. 9A, and a correcting factor KB for the bring-away rate B is searched from the time θINJ of completion of the fuel injection based on a map in FIG. 9B.

If the target air-fuel ratio A/F for each of the cylinders $\mathbf{3}_1$, $\mathbf{3}_2$, $\mathbf{3}_3$ and $\mathbf{3}_4$ corresponding to the fuel injection valves $\mathbf{8}_1$, $\mathbf{8}_2$, $\mathbf{8}_3$ and $\mathbf{8}_4$ is lean, the direct rate A is substituted with A×KA, and the bring-away rate B is substituted with B×KB. Using the substituted direct rate A and bring-away rate B, a final amount of fuel injected Ti is calculated according to the following equation:

$$Ti=(T_o-TWP\times B)/A$$

wherein $T_o$ is a basic amount of fuel injected, and TWP is an adhesion amount. The amount of fuel injected from each of the fuel injection valves $\mathbf{8}_1$, $\mathbf{8}_2$, $\mathbf{8}_3$ and $\mathbf{8}_4$ is controlled by this final amount of fuel injected Ti. Thus, an increase in equilibrium adhesion rate in the lean operation can be prevented, and the variation in combustion, the misfiring, the deterioration in emission and the like due to the insufficiency of the fuel within the cylinder can be avoided.

A second embodiment of the present invention will now be described with reference to FIGS. 10 and 11.

In the second embodiment, an EGR amount control is combined with the air-fuel ratio A/F switching control described in the first embodiment. In general, in a stoichiometric operating area of the engine E, EGR is introduced in an amount which does not deteriorate the fuel in order to reduce the specific fuel consumption and to improve the emission. In a lean operating area, the introduction of EGR is discontinued in order to extend the lean operation limit.

When the EGR amount control is combined with the switch-over of the air-fuel ratio A/F sequentially carried out at predetermined intervals for every cylinders $\mathbf{3}_1$, $\mathbf{3}_2$, $\mathbf{3}_3$ and $\mathbf{3}_4$ as in the first embodiment, it is a conventional practice to close the EGR valve quickly as soon as a command to switch over the air-fuel ratio A/F from the stoichiometric value to the lean value is outputted, and to start the control of switch-over of the air-fuel ratio A/F for every cylinder $\mathbf{3}_1$, $\mathbf{3}_2$, $\mathbf{3}_3$ and $\mathbf{3}_4$ from a time point when the flow rate of the EGR gas becomes zero, with a predetermined time lag. In addition, when a command to switch over the air-fuel ratio A/F from the lean value to the stoichiometric value is outputted, the control of switch-over of the air-fuel ratio A/F for every cylinder $\mathbf{3}_1$, $\mathbf{3}_2$, $\mathbf{3}_3$, $\mathbf{3}_4$ is first carried out and after completion of this control, the EGR valve is opened quickly to start the supplying of the EGR gas. However, if the above control is carried out, the following problem is encountered: the EGR valve is closed or opened quickly and hence, the amount of EGR is varied suddenly to generate a torque shock.

Figure 10:
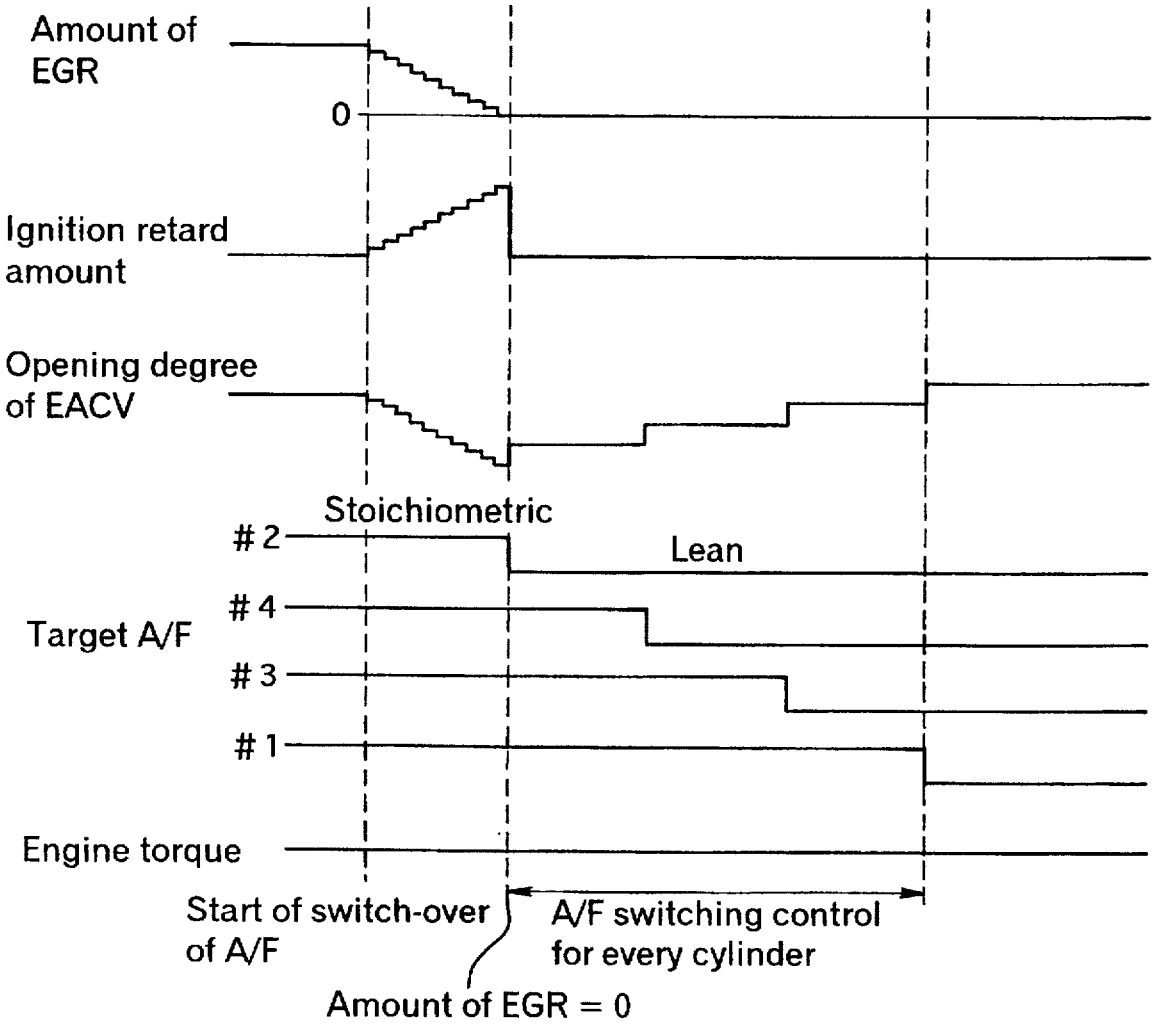
FIG. 10 is a time chart in the switching-over of air-fuel ratio from a stoichiometric value to a lean value according to a second embodiment.
Figure 11:
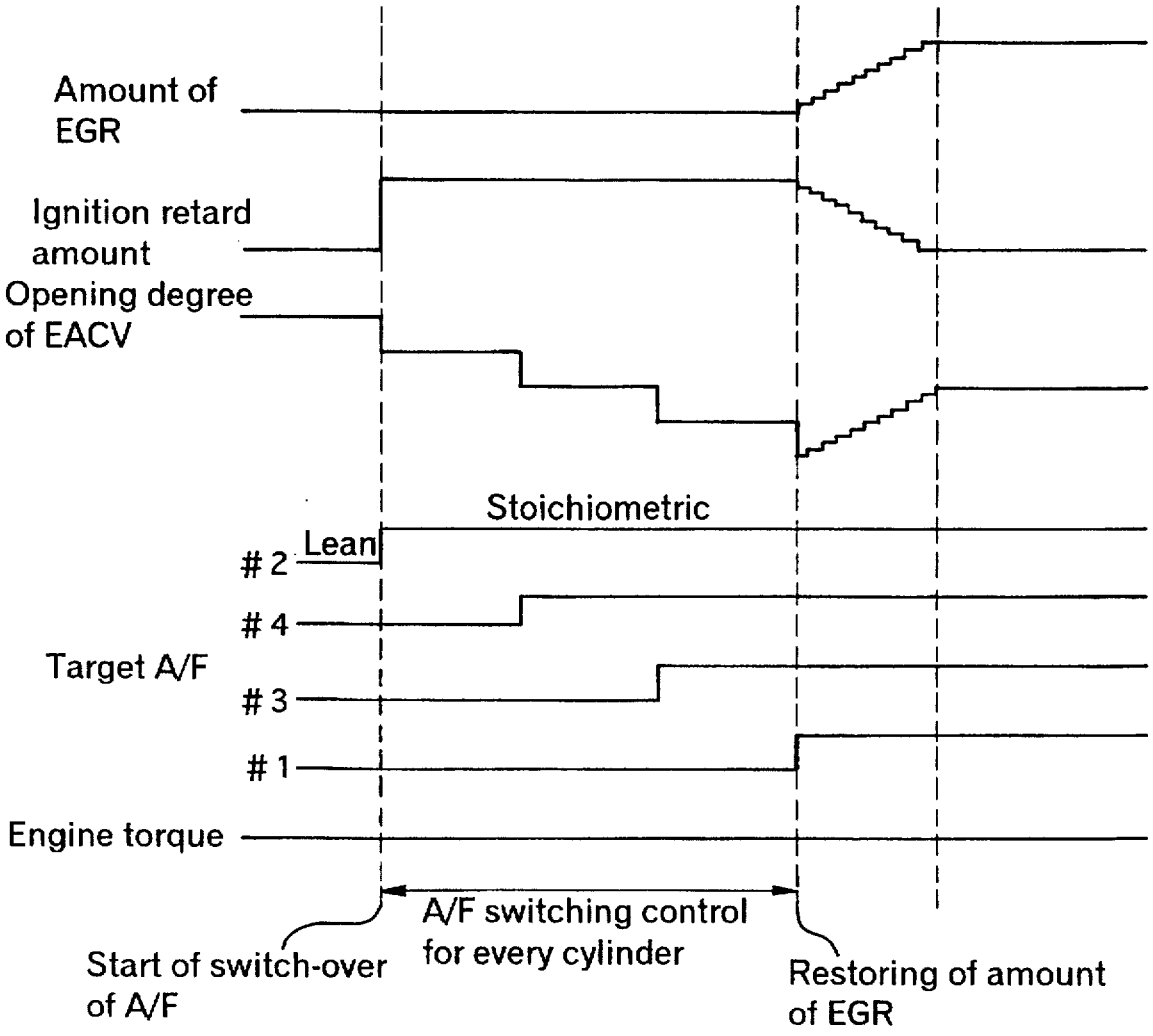
FIG. 11 is a time chart in the switching-over of air-fuel ratio from the lean value to the stoichiometric value according to the second embodiment.

In this embodiment, when the air-fuel ratio A/F is switched over from the stoichiometric value to the lean value, a control as shown in FIG. 10 is carried out. More specifically, even if the air-fuel ratio switching command is outputted, the air-fuel ratio switching control for every cylinder is not immediately started, but the amount of EGR is first gradually decreased toward zero. In order to prevent the engine torque from being gradually increased due to this gradual decrease in amount of EGR, the retarding of the ignition timing and the closing of the EACV 7 are carried out in parallel to the gradual decrease in amount of EGR, thereby maintaining the engine torque flat. When the amount of EGR reaches zero, the same air-fuel ratio switching control for every cylinder as in the first embodiment is carried out, thereby preventing the generation of the torque shock.

Figure 12:
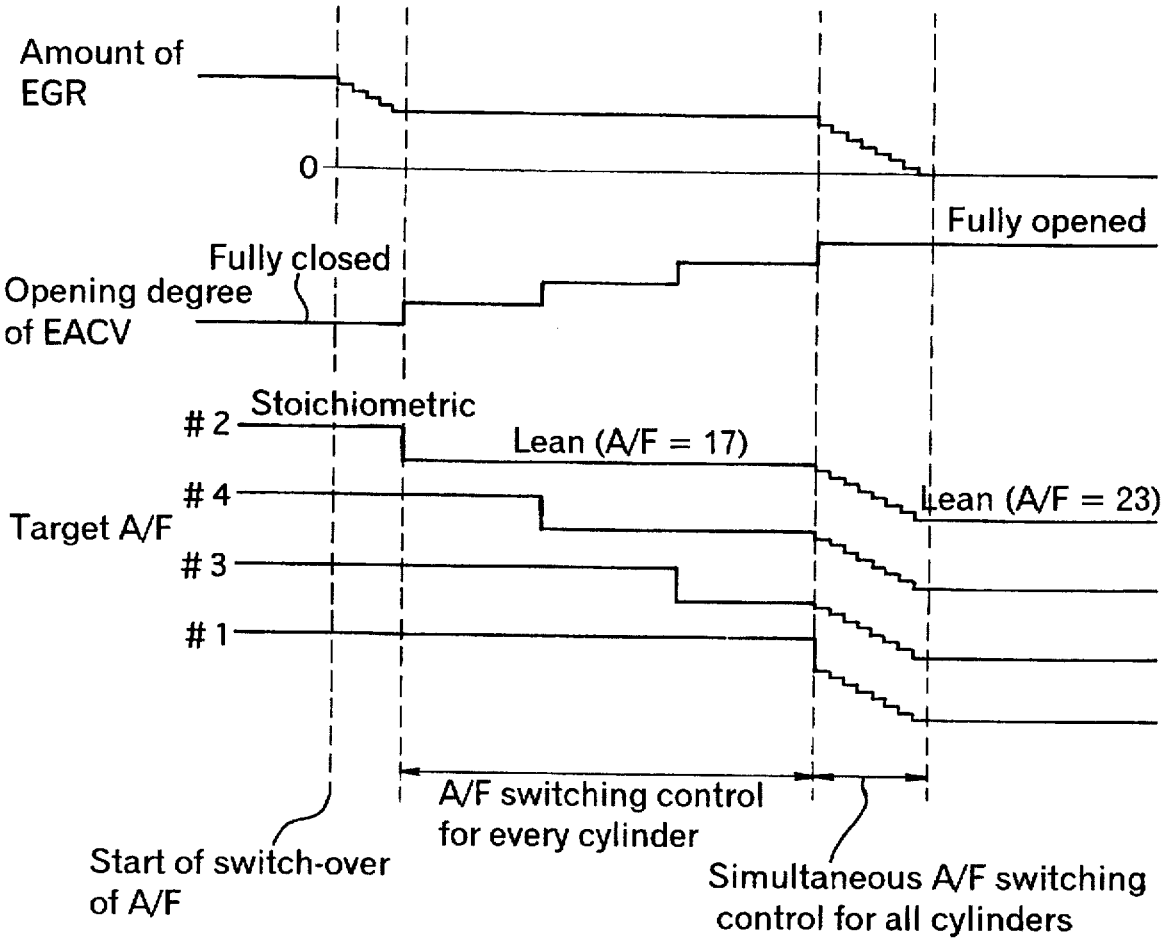
FIG. 12 is a time chart in the switching-over of air-fuel ratio from a stoichiometric value to a lean value according to a third embodiment.

FIG. 12 illustrates a control in switching-over of the air-fuel ratio from the lean value to the stoichiometric value. When the air-fuel ratio switching command is outputted, the air-fuel ratio switching control for every cylinder is started immediately and during this time, the amount of EGR is maintained at zero. When the air-fuel ratio switching control for every cylinder has been completed, the amount of EGR is gradually increased so that it is restored. At this time, in order to prevent the engine torque from being gradually decreased due to the gradual increase in the amount of EGR, the advancing of the ignition timing and the opening of the EACV 7 are carried out in parallel to the gradual increase in the amount of EGR, whereby the engine torque can be maintained flat.

A third embodiment of the present invention will now be described with reference to FIGS. 12 and 13.

The third embodiment is an improved example of the second embodiment. In the second embodiment, when the air-fuel ratio switching control for every cylinder is carried out by the command to switch over the air-fuel ratio from the stoichiometric value to the lean value, the engine torque is increased by increasing the amount of EACV 7 opened, thereby preventing the generation of the torque shock. However, the increase in the amount of air drawn by opening the EACV 7 has a limit and for this reason, even if the EACV 7 is opened particularly in a lean range of the air-fuel ratio A/F (for example, the air-fuel ratio A/F is in a range of 17 to 23), the amount of air drawn may be insufficient, so that the torque shock cannot be sufficiently avoided in some cases. Therefore, in the third embodiment, the air-fuel ratio switching control for every cylinder used in the second embodiment is employed in a stoichiometric-side range of the air-fuel ratio A/F (in a range in which the amount of air drawn by the EACV 7 is not insufficient), and the simultaneous air-fuel ratio switching control for all the cylinders is employed in a lean-side range of the air-fuel ratio A/F (in a range in which the amount of air drawn by the EACV 7 is insufficient).

FIG. 12 shows a control in switching-over of the air-fuel ratio A/F from the stoichiometric value to the lean value. Even if the air-fuel ratio switching command is outputted, the air-fuel ratio switching control for every cylinder is not immediately started. First, the amount of EGR is gradually decreased down to a value corresponding to the mean air-fuel ratio (A/F=17) and then, the separate air-fuel ratio switching control for every cylinder is started. At this time, the target air-fuel ratio is brought into the mean air-fuel ratio rather than the lean air-fuel ratio A/F=23, and during this time, in order to prevent the generation of the torque shock, the EACV 7 is opened to a full opened state in response to the changing of the status ST-AFCHG.

When the air-fuel ratio switching control for every cylinder has been completed, the simultaneous air-fuel ratio switching control for all the cylinders is started, whereby the air-fuel ratio for each of the cylinders $3_1$, $3_2$, $3_3$ and $3_4$ is gradually decreased from the mean air-fuel ratio A/F=17 to the lean air-fuel ratio A/F=23. At this time, in order to compensate for the decrease in engine torque caused by the gradual decrease in air-fuel ratio A/F to prevent the generation of the torque shock, the amount of EGR is gradually decreased. In the lean range in which the amount of air drawn by the opening of the EACV 7 is insufficient, the simultaneous air-fuel ratio switching control for all the cylinders is carried out in place of the separate air-fuel ratio switching control for every cylinder. By using the control of the amount of EGR in combination with such simultaneous air-fuel ratio switching control for all the cylinders, the prevention of the generation of the torque shock and the improvement of the emission can be reconciled.

Figure 13:
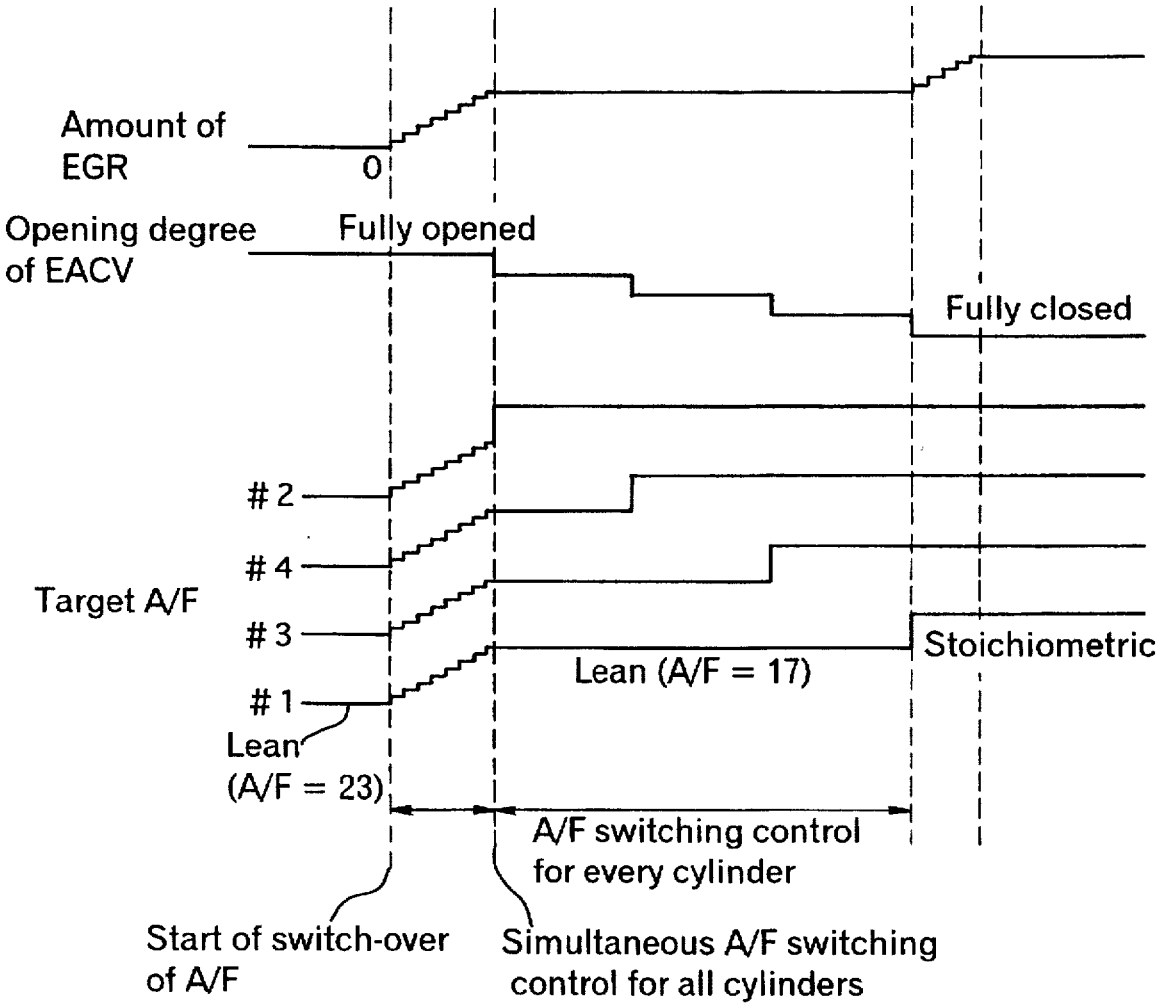
FIG. 13 is a time chart in the switching-over of air-fuel ratio from the lean value to the stoichiometric value according to the third embodiment.

Even when the air-fuel ratio A/F is switched over from the lean value to the stoichiometric value, the simultaneous air-fuel ratio switching control for all the cylinders is first carried out in the lean-side range of the air-fuel ratio A/F and then, the separate air-fuel ratio switching control for every cylinder is carried out in the stoichiometric-side range of the air-fuel ratio A/F, as shown in FIG. 13. Thus, the prevention of the generation of the torque shock and the improvement of the emission can be reconciled in all the air-fuel ratio ranges.

Although the embodiments of the present invention have been described in detail, it will be understood that the present invention is not limited to the above-described embodiments, and various modifications may be made without departing from the spirit and scope of the invention defined in claims.

For example, although the electronic air control valve 7 (EACV 7) has been used as the drawn-air amount control means M3 in the embodiments, a throttle value connected to a motor and opened and closed electrically may be used in place of the electronic air control valve 7. As another example, the invention is equally applicable to engines having more or fewer cylinders or more fuel injection valves per cylinder. Still another example is that the amount of drawn-air controlled by the EACV 7 may be determined on the basis of engine operation conditions in addition to or as substitutes for the above-described intake manifold absolute pressure PBa and the interval between fuel injection amount changes for maintaining a constant torque and/or controlling the quality of the exhaust gas emissions.

What is claimed is:

1. An air-fuel ratio control system for an internal combustion engine, comprising: fuel injection valves provided for cylinders, a target air-fuel ratio setting means for setting a target air-fuel ratio based on an operational state of the internal combustion engine, a fuel injection amount control means for changing the amount of fuel injected from said fuel injection valves for every cylinder based on the target air-fuel ratio, and a drawn-air amount control means for controlling the amount of air drawn into the internal combustion engine, wherein said drawn-air amount control means corrects a basic drawn-air amount in accordance with the change in the amount of fuel injected into each of the cylinders.

2. An air-fuel ratio control system for an internal combustion engine according to claim 1, wherein said fuel injection amount control means sequentially changes the amounts of fuel injected with a predetermined time lag for each fuel injection valve when said target air-fuel ratio setting means has switched the target air-fuel ratio.

3. An air-fuel ratio control system for an internal combustion engine according to claim 1, wherein said drawn-air amount control means corrects the basic amount of air drawn in accordance with a load of the internal combustion engine.

4. An air-fuel ratio control system for an internal combustion engine according to claim 2, wherein said drawn-air amount control means corrects the basic amount of air drawn in accordance with a load of the internal combustion engine.

5. An air-fuel ratio control system for an internal combustion engine according to claim 1, wherein said drawn-air amount control means corrects the basic drawn-air amount in accordance with both an interval between the change in the amount of fuel injected into each of the cylinders and a load on the internal combustion engine.

6. An air-fuel ratio control system for an internal combustion engine according to claim 1, wherein said fuel injection amount control means corrects the amount of fuel injected based on both a timing of the completion of the fuel injection and a load on the internal combustion engine.

7. An air-fuel ratio control system for an internal combustion engine according to claim 1, wherein said fuel injection amount control means sequentially changes the amounts of fuel injected with a predetermined time lag for each fuel injection valve when said target air-fuel ratio setting means has switched the target air-fuel ratio, and said predetermined time lag is longer between the change in fuel amounts injected for first and second fuel injection valves that change than between the change in fuel amounts injected for second and third fuel injection valves that change.

8. An air-fuel ratio control system for an internal combustion engine according to claim 7, wherein said predetermined time lag between the change by said first and second fuel injection valves that change is longer than between the change in fuel amounts injected by any two fuel injection valves that change successively.

9. An air-fuel ratio control system for an internal combustion engine according to claim 1, wherein said engine includes exhaust gas recirculating means and EGR control means for supplying a controlled amount of exhaust gas to the drawn-air amount upon the change in the amount of fuel injected into each of the cylinders.

10. An air-fuel ratio control system for an internal a combustion engine according to claim 9, wherein said EGR control means gradually decreases the amount of recirculated exhaust gas before the basic drawn-air amount is corrected when said target air-fuel ratio setting means has signaled a reduction in the target air-fuel ratio.

11. An air-fuel ratio control system for an internal combustion engine according to claim 10, wherein said EGR control means completes the decrease in recirculated exhaust gas to a zero amount only after the completion of the change in the amount of fuel injected to all the cylinders to the switched target air-fuel ratio.

12. An air-fuel ratio control system for an internal combustion engine, comprising: fuel injection valves provided for cylinders, a target air-fuel ratio setting means for setting a target air-fuel ratio based on an operational state of the internal combustion engine, a fuel injection amount control means for changing the amount of fuel injected from said fuel injection valves for every cylinder based on the target air-fuel ratio, and a drawn-air amount control means for controlling the amount of air drawn into the internal combustion engine, wherein said drawn-air amount control means causes changes in the basic amount of drawn-air to be supplied to the engine for providing an effective amount of drawn-air for maintaining a substantially constant torque produced by the engine during the changes in the amount of fuel injected into each of the cylinders, and wherein said fuel injection amount control means sequentially changes the amounts of fuel injected with a predetermined time lag for each fuel injection valve when said target air-fuel ratio setting means has switched the target air-fuel ratio.

13. An air-fuel ratio control system for an internal combustion engine according to claim 12, wherein said drawn-air amount control means corrects the basic amount of air drawn in accordance with a load of the internal combustion engine.

14. An air-fuel ratio control system for an internal combustion engine, comprising: fuel injection valves provided for cylinders, a target air-fuel ratio setting means for setting a target air-fuel ratio based on an operational state of the internal combustion engine, a fuel injection amount control means for changing the amount of fuel injected from said fuel injection valves for every cylinder based on the target air-fuel ratio, and a drawn-air amount control means for controlling the amount of air drawn into the internal combustion engine, wherein said drawn-air amount control means causes changes in the basic amount of drawn-air to be supplied to the engine for providing an effective amount of drawn-air for maintaining a substantially constant torque produced by the engine during the changes in the amount of fuel injected into each of the cylinders, and wherein said drawn-air amount control means corrects the basic drawn-air amount in accordance with both an interval between the change in the amount of fuel injected into each of the cylinders and a load on the internal combustion engine.

15. An air-fuel ratio control system for an internal combustion engine, comprising: fuel injection valves provided for cylinders, a target air-fuel ratio setting means for setting a target air-fuel ratio based on an operational state of the internal combustion engine, a fuel injection amount control means for changing the amount of fuel injected from said fuel injection valves for every cylinder based on the target air-fuel ratio, and a drawn-air amount control means for controlling the amount of air drawn into the internal combustion engine, wherein said drawn-air amount control means causes changes in the basic amount of drawn-air to be supplied to the engine for providing an effective amount of drawn-air for maintaining a substantially constant torque produced by the engine during the changes in the amount of fuel injected into each of the cylinders, and wherein said fuel injection amount control means corrects the amount of fuel injected based on both a timing of the completion of the fuel injection and a load on the internal combustion engine.

16. An air-fuel ratio control system for an internal combustion engine, comprising: fuel injection valves provided for cylinders, a target air-fuel ratio setting means for setting a target air-fuel ratio based on an operational state of the internal combustion engine, a fuel injection amount control means for changing the amount of fuel injected from said fuel injection valves for every cylinder based on the target air-fuel ratio, and a drawn-air amount control means for controlling the amount of air drawn into the internal combustion engine, wherein said drawn-air amount control means causes changes in the basic amount of drawn-air to be supplied to the engine for providing an effective amount of drawn-air for maintaining a substantially constant torque produced by the engine during the changes in the amount of fuel injected into each of the cylinders, and wherein said fuel injection amount control means sequentially changes the amounts of fuel injected with a predetermined time lag for each fuel injection valve when said target air-fuel ratio setting means has switched the target air-fuel ratio, and said predetermined time lag is longer between the change in fuel amounts injected for first and second fuel injection valves that change than between the change in fuel amounts injected for second and third fuel injection valves that change.

17. An air-fuel ratio control system for an internal combustion engine according to claim 16, wherein said predetermined time lag between the change by said first and second fuel injection valves that change is longer than between the change in fuel amounts injected by any two fuel injection valves that change successively.

18. An air-fuel ratio control system for an internal combustion engine, comprising: fuel injection valves provided for cylinders, a target air-fuel ratio setting means for setting a target air-fuel ratio based on an operational state of the internal combustion engine, a fuel injection amount control means for changing the amount of fuel injected from said fuel injection valves for every cylinder based on the target air-fuel ratio, and a drawn-air amount control means for controlling the amount of air drawn into the internal combustion engine, wherein said drawn-air amount control means causes changes in the basic amount of drawn-air to be supplied to the engine for providing an effective amount of drawn-air for maintaining a substantially constant torque produced by the engine during the changes in the amount of fuel injected into each of the cylinders, and wherein said engine includes exhaust gas recirculating means and EGR control means for supplying a controlled amount of exhaust gas to the drawn-air amount upon the change in the amount of fuel injected into each of the cylinders.

19. An air-fuel ratio control system for an internal combustion engine according to claim 18, wherein said EGR control means gradually decreases the amount of recirculated exhaust gas before the basic drawn-air amount is corrected when said target air-fuel ratio setting means has signaled a reduction in the target air-fuel ratio.

20. An air-fuel ratio control system for an internal combustion engine according to claim 19, wherein said EGR control means completes the decrease in recirculated exhaust gas to a zero amount only after the completion of the change in the amount of fuel injected to all the cylinders to the switched target air-fuel ratio.

* * * * *